US009237788B2

(12) United States Patent
Scumaci

(10) Patent No.: US 9,237,788 B2
(45) Date of Patent: Jan. 19, 2016

(54) BRISTLE HAIR ROLLER

(71) Applicant: Mina Marie Scumaci, Woodridge, IL (US)

(72) Inventor: Mina Marie Scumaci, Woodridge, IL (US)

( * ) Notice: Subject to any disclaimer, the term of this patent is extended or adjusted under 35 U.S.C. 154(b) by 0 days.

(21) Appl. No.: 14/460,532

(22) Filed: Aug. 15, 2014

(65) Prior Publication Data

US 2015/0047668 A1 Feb. 19, 2015

Related U.S. Application Data

(60) Provisional application No. 61/959,114, filed on Aug. 15, 2013.

(51) Int. Cl.
*A45D 2/14* (2006.01)

(52) U.S. Cl.
CPC ..... *A45D 2/145* (2013.01); *A45D 2/148* (2013.01)

(58) Field of Classification Search
CPC ..... A45D 2/02; A45D 2/08; A45D 2/10; A45D 2/12; A45D 2/122; A45D 2/18; A45D 2/20; A45D 2/22; A45D 2/2471; A45D 6/02; A45D 6/04; A45D 7/00; A45D 2007/004; A45D 2/145; A45D 2/148; A45D 2/00; A45D 2/146; A45D 2/2485; A45D 2/36; A45D 7/02; A46B 9/02; A46B 9/026; A46B 9/028; A46B 2200/104; A46B 9/00; A46B 9/023; A46B 9/021
USPC ..... 132/262, 200, 210, 211, 223, 226, 245, 132/246, 250, 265, 266, 120, 145, 150, 55, 132/237, 212
See application file for complete search history.

(56) References Cited

U.S. PATENT DOCUMENTS

| | | | | | |
|---|---|---|---|---|---|
| 2,892,460 | A | * | 6/1959 | Leclabart | 132/245 |
| 2,954,788 | A | * | 10/1960 | Madore | 132/262 |
| 3,050,070 | A | * | 8/1962 | Sidelman | 132/262 |
| 3,057,365 | A | * | 10/1962 | Buzzelli et al. | 132/262 |
| 3,507,291 | A | * | 4/1970 | Gaxiola | 132/210 |
| 3,565,083 | A | * | 2/1971 | Popeil | 132/211 |
| 3,593,724 | A | * | 7/1971 | Leal | 132/254 |
| 3,967,630 | A | * | 7/1976 | Zuhlsdorff et al. | 132/262 |
| 4,076,032 | A | * | 2/1978 | Misercola | 132/212 |
| 5,479,951 | A | * | 1/1996 | Denebeim | 132/265 |
| 5,573,016 | A | * | 11/1996 | Graves | 132/254 |
| 5,622,193 | A | * | 4/1997 | Pekarik | 132/254 |
| 5,887,600 | A | * | 3/1999 | Wilk | 132/262 |
| 5,954,064 | A | * | 9/1999 | Motherhead | 132/262 |
| 6,341,611 | B1 | * | 1/2002 | Nakamura | 132/120 |
| 6,363,946 | B1 | * | 4/2002 | Sumner | 132/265 |
| 6,412,495 | B1 | * | 7/2002 | Belman et al. | 132/210 |
| 6,502,585 | B1 | * | 1/2003 | Mazzei et al. | 132/237 |
| 7,296,580 | B1 | * | 11/2007 | Sbardella | 132/122 |
| 7,654,269 | B1 | * | 2/2010 | Boyle | 132/120 |
| 7,832,413 | B2 | * | 11/2010 | Walters et al. | 132/108 |
| 2003/0070244 | A1 | * | 4/2003 | McEntyre et al. | 15/160 |

(Continued)

*Primary Examiner* — Vanitha Elgart
(74) *Attorney, Agent, or Firm* — Erickson Law Group, PC

(57) ABSTRACT

A roller for creating a curl, wave, or volume in human hair extending across a width of a human head is disclosed. The roller has cylinder and a plurality of bristle groups. The cylinder has a first end, a second end, a cylindrical side wall, a central passage, and a plurality of vent apertures. Each bristle group comprises a plurality of bristles. The cylindrical side wall extends between the first and second end. The central passage extends within the cylinder between the first and second end. The plurality of bristle groups are spaced about the cylindrical side wall.

12 Claims, 8 Drawing Sheets

(56) References Cited

U.S. PATENT DOCUMENTS

| | | | | |
|---|---|---|---|---|
| 2004/0154631 | A1* | 8/2004 | Nawrocki | 132/262 |
| 2006/0042648 | A1* | 3/2006 | Teller | 132/237 |
| 2006/0130866 | A1* | 6/2006 | Shimomura | 132/226 |
| 2008/0251094 | A1* | 10/2008 | Wells et al. | 132/226 |
| 2009/0217935 | A1* | 9/2009 | Akerman | 132/120 |
| 2009/0229624 | A1* | 9/2009 | Purvis et al. | 132/120 |
| 2010/0307519 | A1* | 12/2010 | Couillard | 132/120 |
| 2011/0114111 | A1* | 5/2011 | Guthans | 132/211 |
| 2014/0020705 | A1* | 1/2014 | Parker et al. | 132/270 |

* cited by examiner

BRISTLE HAIR ROLLER

This application claims the benefit of U.S. Provisional Patent Application No. 61/959,114, filed on Aug. 15, 2013, which is hereby incorporated by reference in its entirety.

FIELD OF THE INVENTION

This invention relates in general to devices for creating volume, wave, and or curls in human hair.

BACKGROUND OF THE INVENTION

Rollers are known for use in creating curls in human hair. Certain prior art rollers have VELCRO provided on the exterior of the rollers.

The present inventor recognized the need for a roller that has longer length to eliminate or minimize unwanted parting lines on a top hair section of a user's head. The present inventor recognized the need for a roller that will save time, energy, and effort by enabling use with a wider section of hair as compared to conventional rollers. The present inventor recognized that VELCRO attracts lint and more easily tangles hair and causes hair follicle breakage.

The present inventor recognized that the prior art roller have a tendency to fall out of a user's hair and require the use of pins or clips to secure the roller in place. The present inventor recognized the need for a roller with bristles that provides a gripping effect and do not require pins, clips, or other hardware to secure the roller to a user's hair.

The present inventor recognized the need for a roller that can be used on all hair types and on people of all ages. The present inventor recognized the need for a roller that can be used to add volume, and or create curls or waves in hair whether hair starts out wet or dry. The present inventor recognized the need for an efficient, time-saving, roller that would provide increased functionality and convenience for the user.

SUMMARY OF THE INVENTION

A roller for creating volume, waves and or curl in human hair is disclosed. The roller has a cylinder and a plurality of bristle groups. The cylinder has a first end, a second end, a cylindrical side wall, a central passage, and a plurality of vent apertures. Each bristle group comprises a plurality of bristles. The cylindrical side wall extends between the first and second end. The central passage extends within the cylinder between the first and second end. The plurality of bristle groups are spaced about along the length and circumference of the cylindrical side wall. The bristle apertures extend along a length of the cylinder. The plurality of vent apertures communicate through the cylindrical wall from an exterior to the central passage. The plurality of vent apertures are spaced about among the bristle groups.

Numerous other advantages and features of the present invention will become readily apparent from the following detailed description of the invention and the embodiments thereof, from the claims, and from the accompanying drawings.

DETAILED DESCRIPTION

Figure 6:
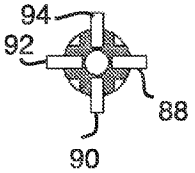
FIG. 6 is a section view of the roller of FIG. 1 taken along line 6-6 of FIG. 1.

The following description is presented to enable any person skilled in the art to make and use the invention. For the purposes of explanation, specific nomenclature is set forth to provide a plural understanding of the present invention. While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1-6 show a first embodiment hair roller 50 of the invention. The roller 50 comprises a body cylinder 52. The cylinder 52 has flat opposite first and second ends 54, 56. The cylinder 52 has a plurality of bristles 70, 74, 78, 82, 84, 86, 88, 90, 92, 94. The bristles are located in alternating circumferential rows of bristles 58, 60, 64, 62, 66. Not all bristles and rows are labeled as can be seen in the figures. Each row comprises bristles spaced apart about the cylinder. Each breather hole, such as holes 72, 76, is located between each bristle in each row. Therefore row 58 has a hole 72 located between adjacent bristles 70, 74. In row 58 there is a hole between each of the following pairs of bristles 70,74; 74, 78; 78, 79; 79, 70. Each bristle 70 is friction fitted into a bristle opening 71 of the cylinder.

In each row of bristles, the bristles are spaced apart at 90 degree increments about the cylinder. Each breather hole is spaced apart at 90 degree increments about the cylinder. The breather holes are offset from the bristles by 45 degrees. Therefore a bristle or breather hole will be found at every 45 degree increment starting from a bristle or a breather hole about the cylinder in a row.

The bristles in each adjacent row are offset by 45 degree from the other. Therefore the bristles in row 60 are offset by 45 degrees from the bristles in row 58 and row 62. The bristles in every other row are aligned. Therefore, the bristles in row 60 are aligned with the bristles in row 62. Likewise the breather holes are offset by 45 degrees in adjacent rows and aligned in every second row.

Figure 5:
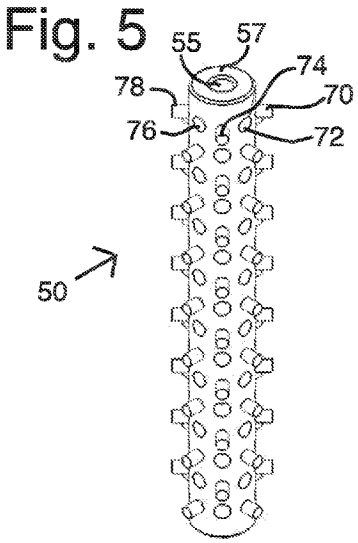
FIG. 5 is a perspective view of the roller of FIG. 1.
Figure 4:
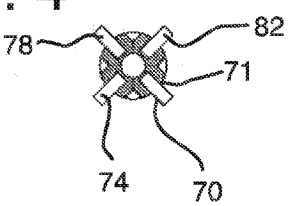
FIG. 4 is a section view of the roller of FIG. 1 taken along line 4-4 of FIG. 1.
Figure 3:
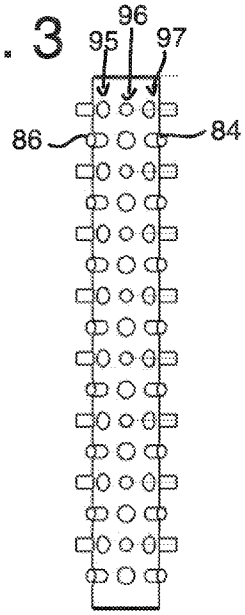
FIG. 3 is a side view of the roller of FIG. 1 turned 45 degrees.
Figure 2:
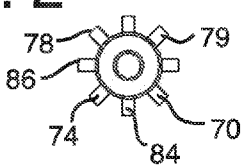
FIG. 2 is an end view of the roller of FIG. 1.
Figure 1:
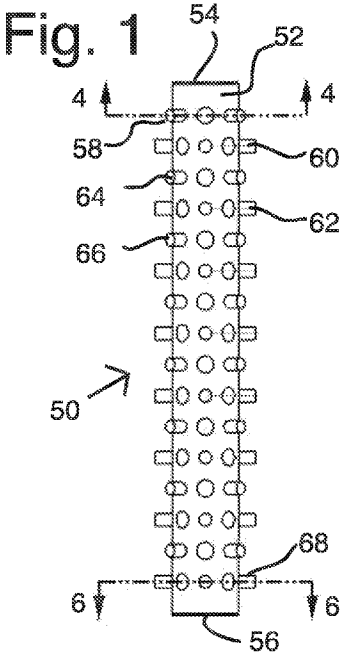
FIG. 1 is a front view of a first embodiment roller of the invention.
Figure 7:
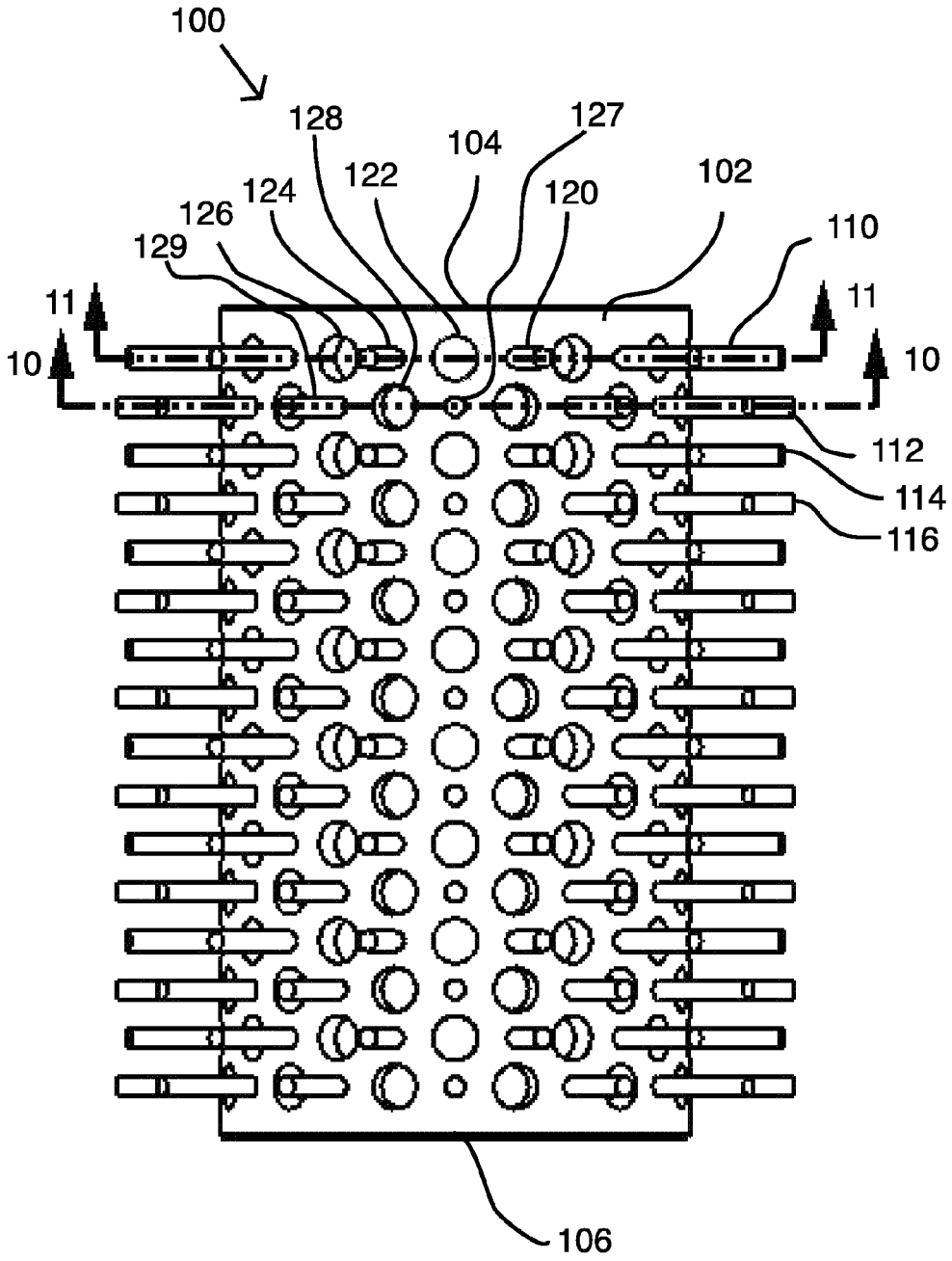
FIG. 7 is a second embodiment roller of the invention.
Figure 8:
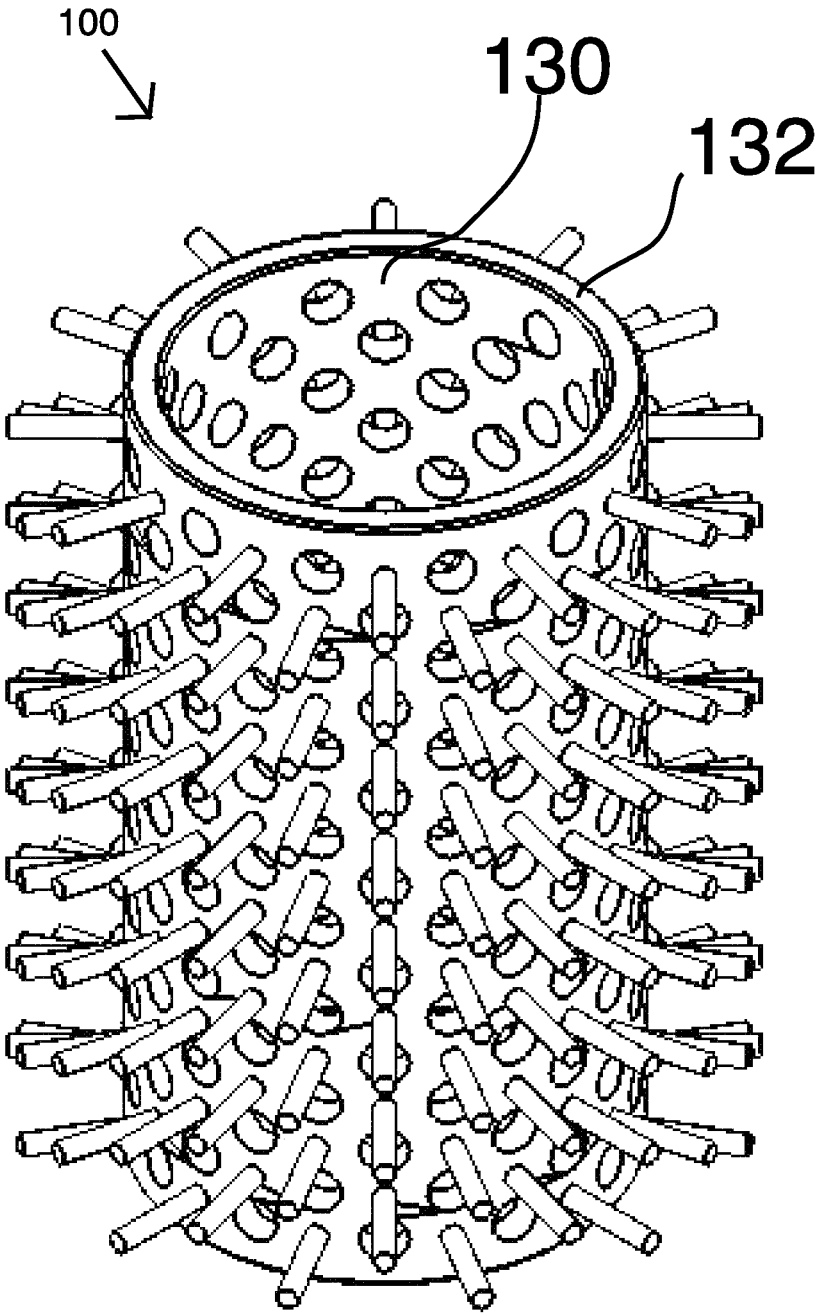
FIG. 8 is a perspective view of the roller of FIG. 7.
Figures 9, 10, 11:
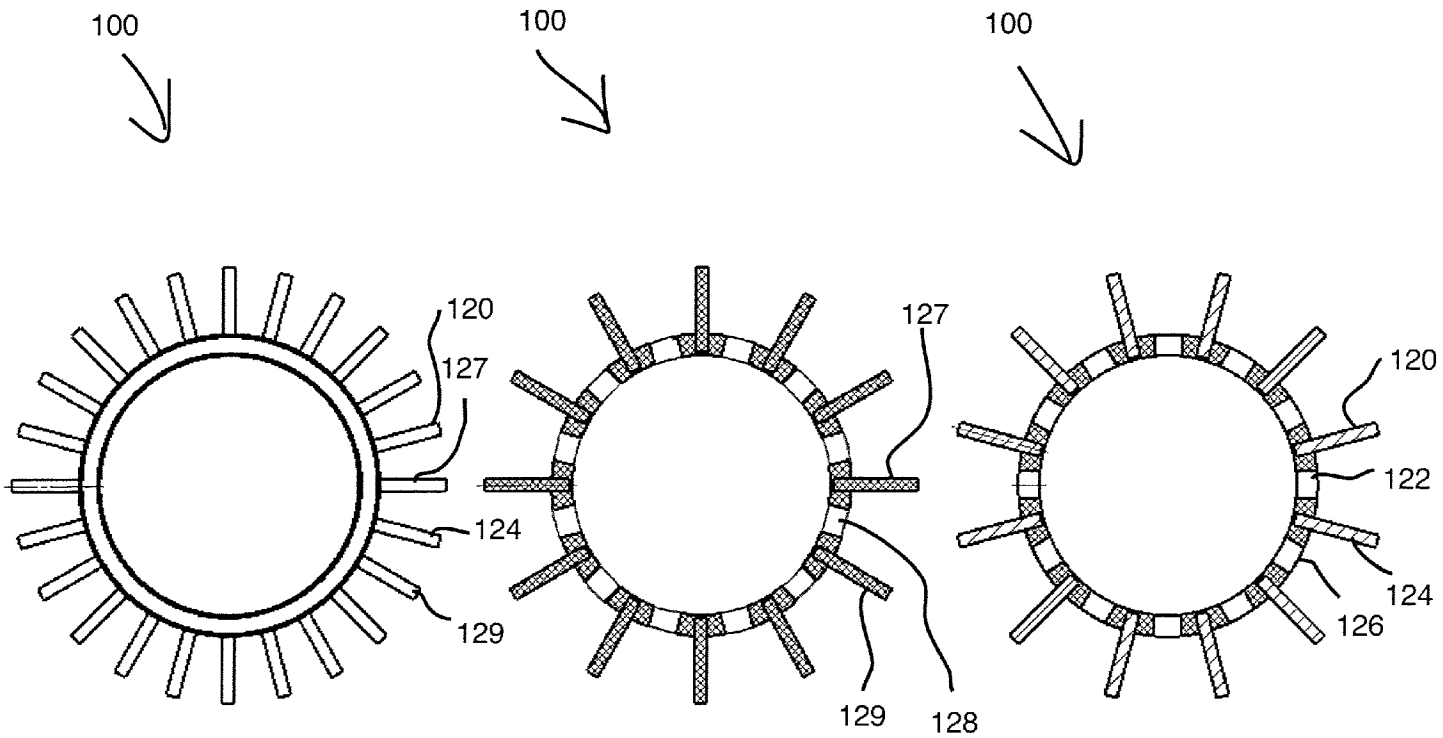
FIG. 9 is an end view of the roller of FIG. 7.
FIG. 10 is a section view of the roller of FIG. 7 taken along line 10-10 of FIG. 7.
FIG. 11 is a section view of the roller of FIG. 7 taken along line 11-11 of FIG. 7.

As can be seen from FIGS. 1, 3, and 5 longitudinal rows, such as rows 95, 96, 97 are formed by the bristles and breather holes. Row 96 begins with a bristle, followed by a breather holes, then alternates between bristles and breather holes. Rows 95 and 97 begin with breather holes, then alternate between bristles and breather holes as shown in the figures.

In one embodiment, the bristles 70, 74, 78, 79 in the first row 58 are offset by 45 degrees from the bristles 90, 92, 94, 99 of the last row 68. In some embodiments, the bristles of the first and last row are aligned.

The roller 50 comprises a central hollow passage 55 that extends from the first end 54 to the second end 56. The thickness of the cylinder creates circular donut face 57 at each end. Each of the breather holes connect to the central hollow passage 55.

In one embodiment, the cylinder has an outside diameter of 0.5 inch. The bristle has a length of 0.125 inch between the cylinder and the end of the bristle. Therefore the roller has a maximum diameter of 0.75 inch.

A second embodiment hair roller 100 is shown in FIGS. 7-11. The roller has a body cylinder 102. The cylinder 102 has flat opposite first and second ends 104, 106. The cylinder 102 has a plurality of bristles 120, 127, 124, 129. The bristles are located in alternating circumferential rows of bristles 110, 112, 114, 116. Not all bristles and rows are labeled as can be seen in the 10 figures. Each row comprises bristles spaced apart about the cylinder. Each breather hole, such as holes 122, 126, 128, is located between each bristle in each row.

In each row of bristles, the bristles are spaced apart at 30 degree increments about the cylinder. Each breather hole is spaced apart at 30 degree increments about the cylinder. The breather holes are offset from the bristles by 15 degrees. Therefore a bristle or breather hole will be found at every 15 degree increment starting from a bristle or a breather hole about the cylinder in a row. The bristles in each adjacent row are offset by 15 degrees from the other. In some embodiments, the cylinder has an outside diameter of 3.25 inches.

The roller 100 comprises a central hollow passage 130 that extends from the first end 104 to the second end 106. The thickness of the cylinder creates a circular donut face 132 at each end. Each of the breather holes connect to the central hollow passage 130.

In some embodiments, the bristle to bristle spacing between each adjacent bristle in each row and the breather to breather hole spacing between adjacent breather holes in each row is provided in 36, 40, 60, degree increments about the cylinder. The breather holes are offset from the bristles by half of bristle to bristle spacing. In some embodiments, the cylinder has an outside diameter of 1.25, 2.25, or 2.75 inches, corresponding to the bristle to bristle spacing of 36, 40, or 60 degrees, respectively.

In some embodiments, the bristle to bristle spacing between each adjacent bristle in each row and the breather to breather spacing between adjacent breather holes in each row is provided in 50.43 degree increments about the cylinder. The breather holes are offset from the bristles by 25.71 degrees and the cylinder has an outside diameter of 1.75 inches.

The roller 50, 100 has a length between the first and second ends that is greater or equal to three inches. In some embodiments, the roller has a length that is from 3 to 5.5 inches, and preferably 4 inches. The longer length prevents unwanted parting lines 26 in a user's hair.

Figure 12:
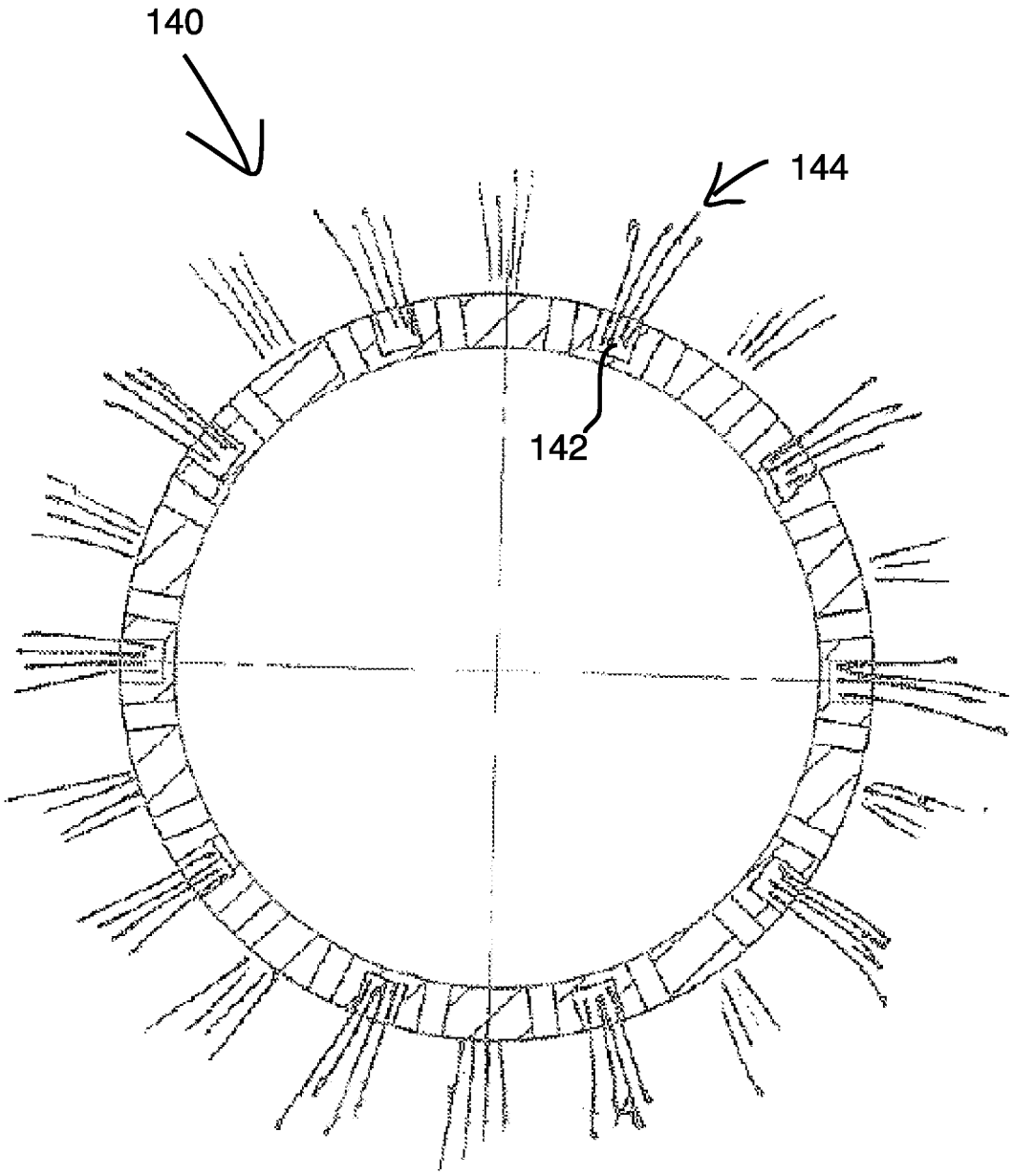
FIG. 12 is a cross-section view of a third embodiment roller.

In some embodiments, the bristles comprise natural boar hair, vinyl, plastic, natural animal hair, glass fibers, and/or a combination of the same. The bristles create a gripping action when the bristles are engaged with human hair so that the roller does not inadvertently fallout of the hair. As shown in FIG. 12, in some embodiments, one, multiple, or every bristle aperture 142 comprises multiple bristles in a bristle group 144. The third embodiment roller 140 is the same as roller 100 except for the use of multiple bristles in a bristle group and the varying bristle lengths. Bristle groups can be used in roller 50, 100 or other rollers. In some embodiments, each bristle of the bristle group 144 will not be the same length as shown in FIG. 12. In some embodiments, one or more bristle groups have a height that differs from one or more other bristle groups. In some embodiment, adjacent bristle group in a row and/or a column have differing heights. In some embodiments, the bristles are longer than 0.125 inches. In some embodiments, the cylinder is or comprises plastic, metal, ceramic, or a combination thereof.

Figure 13:
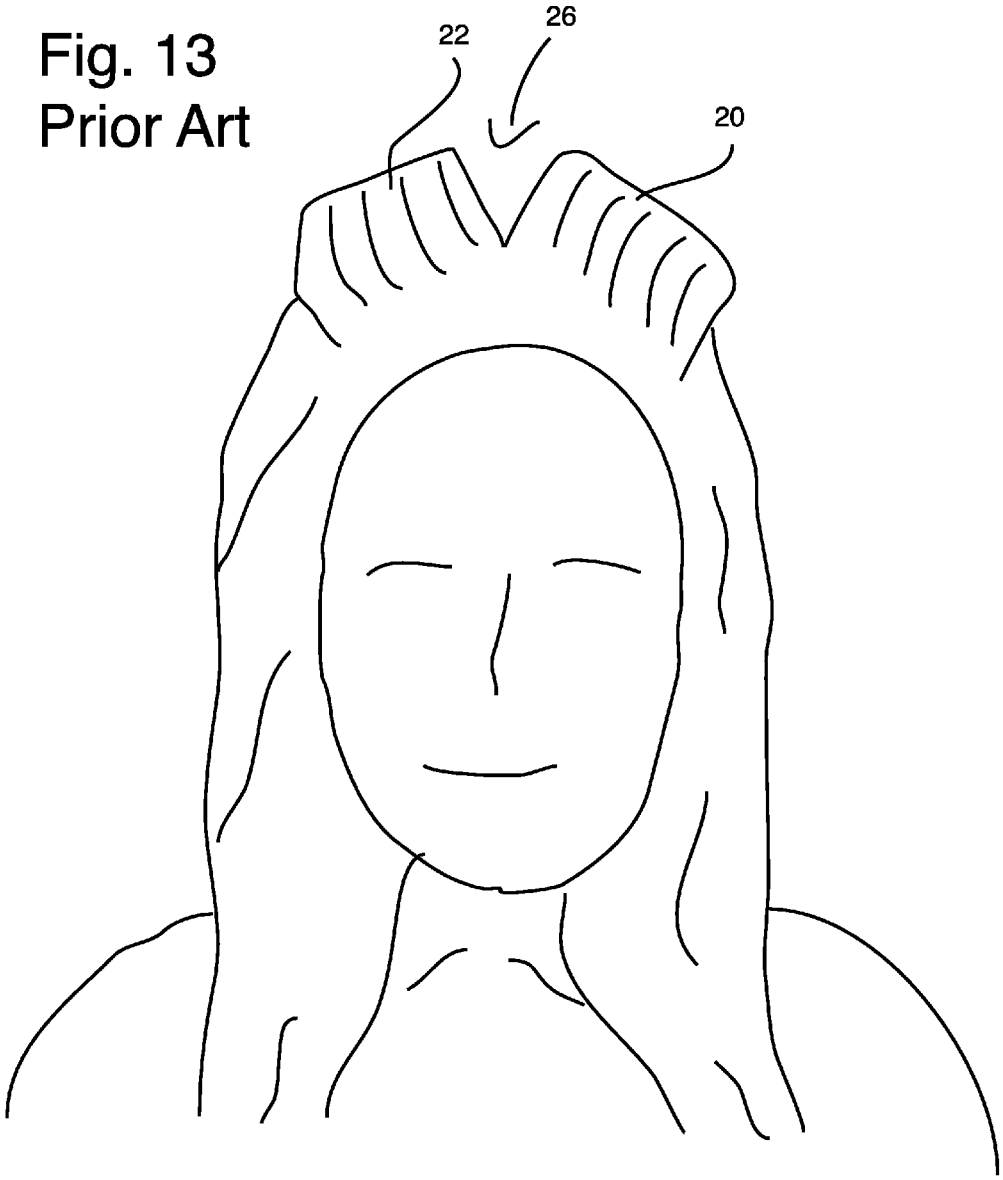
Fig. 13 Prior Art
FIG. 13 is a front view of a prior art rollers deployed in one type of application.
Figure 14:
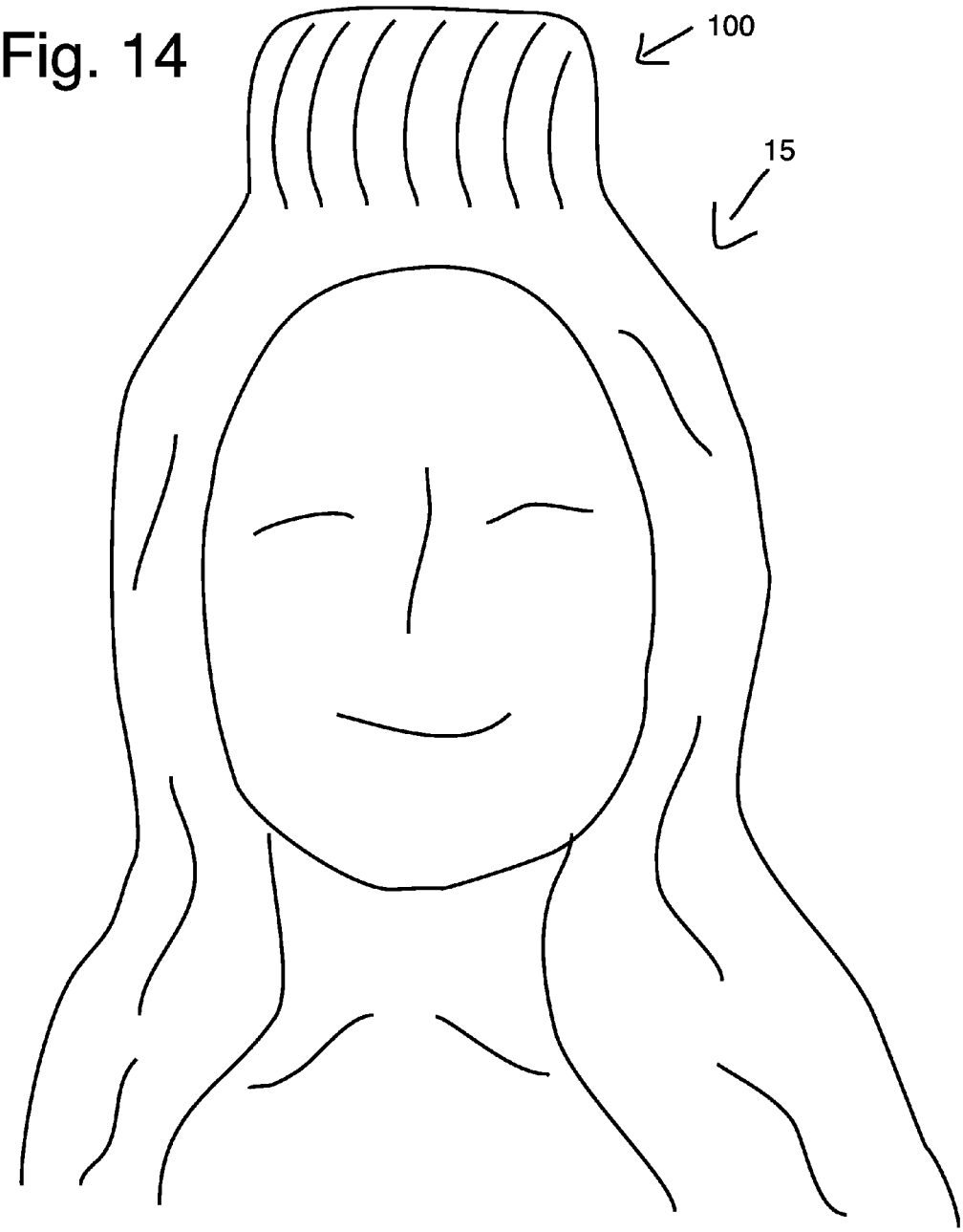
FIG. 14 is a front view of the roller of FIG. 7 deployed in one type of application.

FIG. 14 shows the roller 100 covered by a user's 15 hair. The roller 100 provide sufficient length so that it extends substantially across the entire width of the user's head. Therefore the user is able to use the roller to create curls that extend substantially across the entire top width of the user's head. The roller can also add waves and/or volume to the hair. Adding volume to the hair comprises where the hair appears fuller and/or occupies a larger area. This is an improvement over the prior art rollers 20, 22 shown in FIG. 13 that are too short. Therefore, as shown in FIG. 13, the user is required to use multiple rollers to create curls substantially across the entire top width of the user's head. The multiple roller use creates often unwanted parting line 26 in the gap between the rollers 20, 22. The prior art rollers 20, 22 tend to be pulled apart by gravity acting on the roller and hair attached to each roller, which creates the parting line 26 in the resulting hair style. While the roller 100 is shown placed at the top of the user's head in FIG. 14, it will be recognized that the roller 100 can be placed in at the back and/or on the sides of the head and/or in any other area about the head were a curl, a wave, or volume is desired in the hair. Further, multiple rollers can be used in the hair about the head to create the desired hair style at the desired locations. In some embodiments, substantially across the entire top width of a user's head, comprises plus or minus 0.5 inches of the actual width of the top of the user's head.

Figure 15:
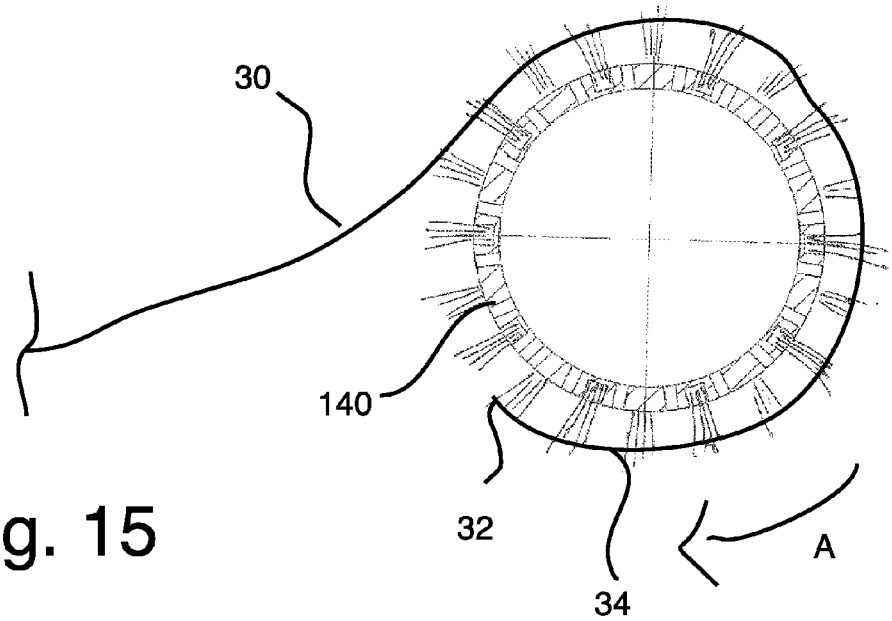
FIG. 15 is a side view of the roller of FIG. 12 shown in one stage of deployment on a portion of hair diagrammatically shown as 30.
Figure 16:
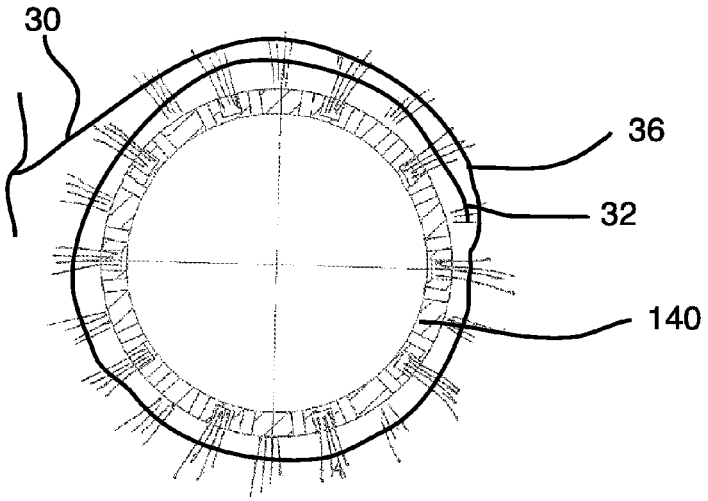
FIG. 16 is a side view of the roller of FIG. 15 shown in a second stage of deployment.

As shown in FIGS. 15 and 16, to use the roller 50, 100, 140 of the invention, the user grasps a portion of hair 30 to be curled extending across the top of the user's head. Instead or in addition to creating a curl the roller can be used to add volume to or create a wave or waves in the user's hair. The grasped hair 30 has a width that is at least the width of the roller. The user then positions the roller at the end 32 or an end portion 34 of the hair 30, opposite the scalp. The user then holds, with his or her hand, the end 32 of the hair, or an end portion 34 of the hair adjacent the end, against the bristles and/or cylinder of the roller 140. As the user holds the hair against the roller, the bristles will be forced between the hair stands or between groups of hair strands or the hair stands will be forced between the bristles, to create a gripping action to hold the roller to the hair. The user then rolls the roller along the hair 30, in the counterclockwise direction A of FIG. 15, until the end 32 is overlapped 36 by another hair portion of the hair 30. Each time a bristle meets the hair strands, the bristle is forced between the hair strands, or vice versa, to create the griping action between the hair and the bristle. After the overlap, the end 32 or end portion 34 need not be held against the roller by the user's hand as the overlapping hair will hold the end 32 or end portion 34 against the roller. The user continues to roll the roller in the counterclockwise direction along hair to accumulate the hair 30 around the roller until the roller is at or adjacent the user's scalp and no further hair in the portion of the hair to be curled 30 is available to be wrapped around the roller 140.

While the roller is shown being rolled in the counterclockwise direction in FIGS. 15 and 16, the roller can be rolled in any desired direction which results in the hair being wrapped around the roller. The bristles will infuse into the hair and create a gripping action to hold the roller in the hair without the use of clips, pins, or other securing devices. Two, three or more layers of hair may be wrapped round the roller depending on the length of hair to be curled.

After the hair is rolled around the roller, hair spray or other product can be applied. Further, heat can be applied, such as through the use of a hair heat lamp or hair dryer. After a predetermined amount of time from 1 minute to 15 minutes to two hours, the rollers can be removed from the hair by rolling the roller in the opposite direction of the direction that the roller was deployed into the hair. When the roller is removed, the corresponding hair portion will maintain a curl, a wave, or will have added volume. Whether a wave or a curl is created depends at least on the length of the hair curled, whether the roller was placed in the hair when the hair was wet or dry, and the diameter of the roller used. The use of the roller in the hair generally will add volume to the hair whether the hair is curled or waved. Waves at least tend to result when the rollers are placed in dry hair. Curls at least tend to result when rollers are placed in wet hair. The roller 50, 100, 140 of the invention can be used with other known techniques for creating volume, wave, and/or curls in human hair.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A roller for creating volume, a wave, or a curl in human hair, comprising:

a cylinder comprising a first end, a second end, a cylindrical side wall, a central passage, a plurality of vent apertures, and a plurality of bristle apertures;

a plurality of bristle groups, each bristle group comprises a plurality of bristles, each bristle group of the plurality of bristle groups is fixed within a corresponding bristle aperture of the plurality of bristle apertures;

the cylindrical side wall extends longitudinally between the first end and the second end, the central passage extends within the cylinder between the first end and the second end;

the plurality of bristle groups are spaced about along a length and a circumference of the cylindrical side wall, the bristle groups extend along a longitudinal length of the cylinder that is between 3.5 inches and 5 inches;

the plurality of vent apertures communicate through the cylindrical side wall to the central passage;

each vent aperture of the plurality of vent apertures comprises a diameter that is greater than a diameter of each bristle aperture of the plurality of bristle apertures;

the plurality of bristle apertures are aligned in a plurality of columns extending longitudinally from the first end to the second end, the plurality of bristle apertures are aligned in a plurality of rows extending about the circumference of the cylindrical side wall, each of the plurality of columns is perpendicular to each of the plurality of rows, the plurality of rows comprise a first end row adjacent to the first and a second end row adjacent to the second end and at least one intermediate row;

the plurality of vent apertures are aligned in the plurality of columns extending longitudinally from the first end to the second end, the plurality of vent apertures are aligned in the plurality of rows extending about the circumference of the cylindrical side wall;

the plurality of bristle apertures in each of the plurality of columns are spaced apart equidistantly;

the plurality of bristle apertures in each of the plurality of rows are spaced apart equidistantly;

the plurality of vent apertures in each of the plurality of columns are spaced apart equidistantly;

the plurality of vent apertures in each of the plurality of rows are spaced apart equidistantly;

in each of the plurality of columns the plurality of bristle apertures are alternatingly interspersed between the plurality of vent apertures where only one bristle aperture of the plurality of bristle apertures is located between adjacent vent apertures of the plurality of vent apertures in the column and where only one vent aperture of the plurality of vent apertures is located between adjacent bristle apertures of the plurality of bristle apertures in the column;

in each of the plurality of rows, the plurality of bristle apertures are alternatingly interspersed between the plurality of vent apertures where only one bristle aperture of the plurality of bristle apertures is located between adjacent vent apertures of the plurality of vent apertures in the row and where only one vent aperture of the plurality of vent apertures is located between adjacent bristle apertures of the plurality of bristle apertures in the row;

the plurality of vent apertures in each column of the plurality of columns are longitudinally offset from the plurality of vent apertures in each first immediately adjacent column of the plurality of columns about the circumference of the cylindrical side wall;

the plurality of bristle apertures in each column of the plurality of columns are longitudinally offset from the plurality of bristle apertures in each first immediately adjacent column of the plurality of columns about the circumference of the cylindrical side wall;

the plurality of vent apertures in each row of the plurality of rows, other than the first end row and second end row, are radially offset from the plurality of vent apertures in each first immediately adjacent row of the plurality of rows in each longitudinal direction;

the plurality of bristle apertures in each row of the plurality of rows, other than the first end row and second end row, are radially offset from the plurality of bristle apertures in each first immediately adjacent row of the plurality of rows in each longitudinal direction;

the plurality of vent apertures in each column of the plurality of columns are aligned with the plurality of vent apertures in each second adjacent column of the plurality of columns about the circumference of the cylindrical side wall;

the plurality of bristle apertures in each column of the plurality of columns are aligned with the plurality of bristle apertures in each second adjacent column of the plurality of columns about the circumference of the cylindrical side wall;

the plurality of vent apertures in each row of the plurality of rows, other than the first end row and second end row, are aligned with the plurality of vent apertures in each second adjacent row of the plurality of rows in each longitudinal direction;

the plurality of bristle apertures in each row of the plurality of rows, other than the first end row and second end row, are aligned with the plurality of bristle apertures in each second adjacent row of the plurality of rows in each longitudinal direction.

2. The roller of claim 1, wherein the bristle apertures extend along a length of the cylinder that is about 4 inches.

3. The roller of claim 1, wherein the cylindrical side wall is about 4 inches in length, and the bristle apertures extend along a length of the cylinder that is between 3.5 and 4 inches.

4. The roller of claim 1, wherein the bristles are natural animal hair.

5. The roller of claim 1, wherein the bristles are plastic.

6. The roller of claim 1, wherein the bristles are vinyl.

7. A roller for creating volume, a wave, or a curl in human hair, comprising:

a cylinder comprising a first end, a second end, a cylindrical side wall, a central passage, a plurality of vent apertures, and a plurality of bristle apertures;

a plurality of bristle groups, each bristle group comprises a plurality of bristles, each of the bristle groups of the plurality of bristle groups is fixed within a corresponding bristle aperture of the plurality of bristle apertures;

the cylindrical side wall extends longitudinally between the first end and the second end, the central passage extends within the cylinder between the first end and the second end;

the plurality of bristle groups are spaced about along a length and a circumference of the cylindrical side wall, the bristle groups extend along a length of the cylinder that is between 3 inches and 5.5 inches;

the plurality of vent apertures communicate through the cylindrical side wall to the central passage;

the plurality of bristle groups are aligned in a plurality of columns extending longitudinally from the first end to the second end, the plurality of bristle groups are aligned in a plurality of rows extending about the circumference of the cylindrical side wall, each of the plurality of columns is perpendicular to each of the plurality of rows, the plurality of rows comprise a first end row adjacent to the first and a second end row adjacent to the second end and at least one intermediate row;

the plurality of vent apertures are aligned in the plurality of columns extending longitudinally from the first end to the second end, the plurality of vent apertures are aligned in the plurality of rows extending about the circumference of the cylindrical side wall;

the plurality of bristle apertures in each of the plurality of columns are spaced apart equidistantly;

the plurality of bristle apertures in each of the plurality of rows are spaced apart equidistantly;

the plurality of vent apertures in each of the plurality of columns are spaced apart equidistantly;

the plurality of vent apertures in each of the plurality of rows are spaced apart equidistantly;

in each of the plurality of columns the plurality of bristle apertures are alternatingly interspersed between the plurality of vent apertures where only one bristle group of the plurality of bristle groups is located between adjacent vent apertures of the plurality of vent apertures in the column and where only one vent aperture of the plurality of vent apertures is located between adjacent bristle groups of the bristle groups in the column;

in each of the plurality of rows, the plurality of bristle apertures are alternatingly interspersed between the plurality of vent apertures where only one bristle group of the plurality of bristle groups is located between adjacent vent apertures of the plurality of vent apertures in the row of the plurality of rows and where only one vent aperture of the plurality of vent apertures is located between adjacent bristle groups of the plurality of bristle groups in the row;

the plurality of vent apertures in each column of the plurality of columns are longitudinally offset from the plurality of vent apertures in each first immediately adjacent column of the plurality of columns about the circumference of the cylindrical side wall;

the plurality of bristle groups in each column of the plurality of columns are longitudinally offset from the plurality of bristle groups in each first immediately adjacent column of the plurality of columns about the circumference of the cylindrical side wall;

the plurality of vent apertures in each row of the plurality of rows, other than the first end row and second end row, are radially offset from the plurality of vent apertures in each first immediately adjacent row of the plurality of rows in each longitudinal direction;

the plurality of bristle groups in each row of the plurality of rows, other than the first end row and second end row, are radially offset from the plurality of bristle groups in each first immediately adjacent row of the plurality of rows in each longitudinal direction;

the plurality of vent apertures in each column of the plurality of columns are aligned with the plurality of vent apertures in each second adjacent column of the plurality of columns about the circumference of the cylindrical side wall;

the plurality of bristle groups in each column of the plurality of columns are aligned with the plurality of bristle groups in each second adjacent column of the plurality of columns about the circumference of the cylindrical side wall;

the plurality of vent apertures in each row of the plurality of rows, other than the first end row and second end row, are aligned with the plurality of vent apertures in each second adjacent row of the plurality of rows in each longitudinal direction;

the plurality of bristle groups in each row of the plurality of rows, other than the first end row and second end row, are aligned with the plurality of bristle groups in each second adjacent row of the plurality of rows in each longitudinal direction.

8. The roller of claim 7, wherein the bristle groups extend along a length of the cylinder that is about 4 inches.

9. The roller of claim 7, wherein the cylindrical side wall is about 4 inches in length, and the plurality of bristle groups extend along a length of the cylinder that is between 3.5 and 4 inches.

10. The roller of claim 7, wherein the bristles are natural animal hair.

11. The roller of claim 7, wherein the bristles are plastic.

12. The roller of claim 7, wherein the bristles are vinyl.

* * * * *